United States Patent [19]

Roth

[11] 4,177,022

[45] Dec. 4, 1979

[54] VESSEL PUMP

[76] Inventor: Peter F. Roth, Schmittenackerstrasse 14, 8304 Wallisellen, Switzerland

[21] Appl. No.: 891,406

[22] Filed: Mar. 29, 1978

[30] Foreign Application Priority Data

Mar. 30, 1977 [CH] Switzerland ..... 4012/77

[51] Int. Cl.[2] ..... F04B 35/04

[52] U.S. Cl. ..... 417/424; 308/238

[58] Field of Search ..... 417/424; 308/238, 139

[56] References Cited

U.S. PATENT DOCUMENTS

| | | | |
|---|---|---|---|
| 2,267,459 | 12/1941 | Hait | 417/424 |
| 2,280,626 | 4/1942 | Carpenter | 417/424 |
| 3,601,459 | 8/1971 | Cutting | 308/238 |
| 4,098,557 | 7/1978 | Claunch et al. | 417/424 X |

*Primary Examiner*—William L. Freeh
*Assistant Examiner*—Edward Look
*Attorney, Agent, or Firm*—Thomas W. Speckman

[57] ABSTRACT

A pump for pumping liquid from a vessel or the like wherein the driving motor drives a driving shaft extending in a delivery pipe and having a delivery rotor in the lower region of the driving shaft, the driving shaft being provided in at least one location with a resilient bearing of two concentrically arranged annular retainer springs formed from a single piece of metal wherein the inner annular retainer spring holds a replaceable slide bearing sleeve through which the driving shaft extends and the outer annular retaining spring is adjacent to and supported by the delivery pipe.

11 Claims, 2 Drawing Figures

VESSEL PUMP

Figure 1:
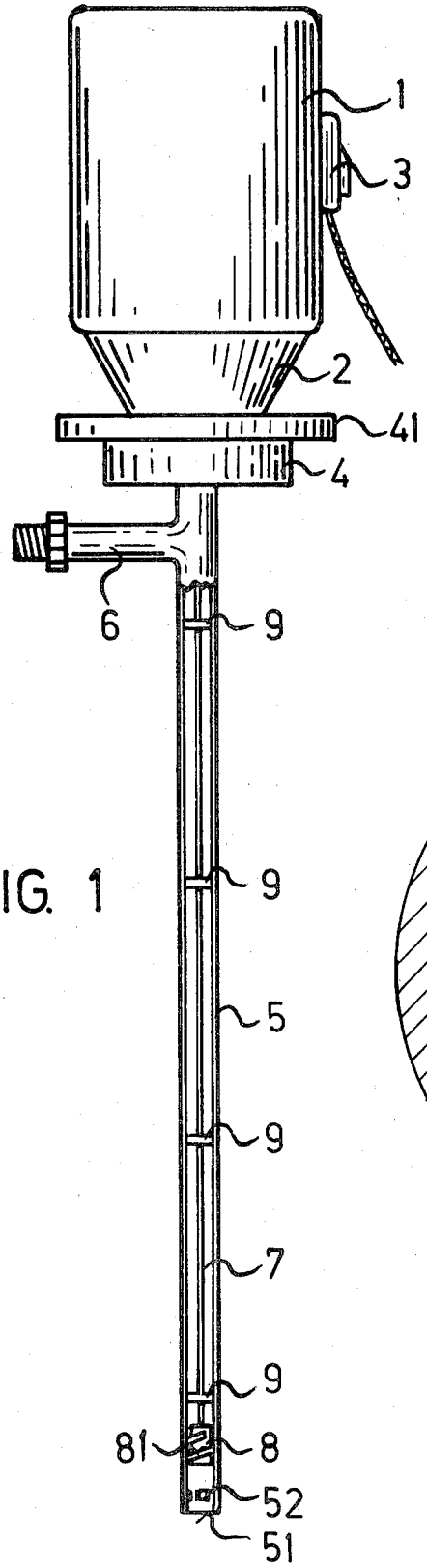

This invention relates to a delivery pump for taking flowable materials from vessels, especially from barrels. Such pumps are mostly called line pumps, barrel pumps or vessel pumps.

All vessel pumps available on the market today have approximately the same construction. For driving the pumps, mostly electric motors are used which are connected with the pumping mechanism by means of a union nut or a plug coupling. The motor transmits its power by way of a coupling to a driving shaft which is guided in a pipe serving as a bearing. The delivery rotor is fastened on the lower end of the driving shaft which must be sealed from the open end of the bearing pipe. A conveying pipe, which leads to the outlet pipe, runs outside and concentrically to the bearing pipe. This construction, common up to now, requires more than 30 individual parts for the pumping mechanism and tends to need frequent repair. The driving shaft and its bearing pipe considerably reduces the useful cross section of the conveying pipe. The relatively rigid bearing of the driving shaft has led to high stress on the bearings.

It is an objective of this invention to develop a vessel pump which requires fewer parts and overcomes the disadvantages of present vessel pumps as pointed out.

This invention provides a vessel pump having a driving motor driving a driving shaft running in a delivery pipe and having a delivery rotor arranged on its lower end wherein the driving shaft is provided with at least one resilient bearing which is supported in the delivery pipe and has two concentrically arranged, annular retainer springs of a single piece of metal, the inner annular retainer spring holding a replaceable friction bearing sleeve around the driving shaft and the outer annular retainer spring supported in the delivery pipe.

Figure 2:
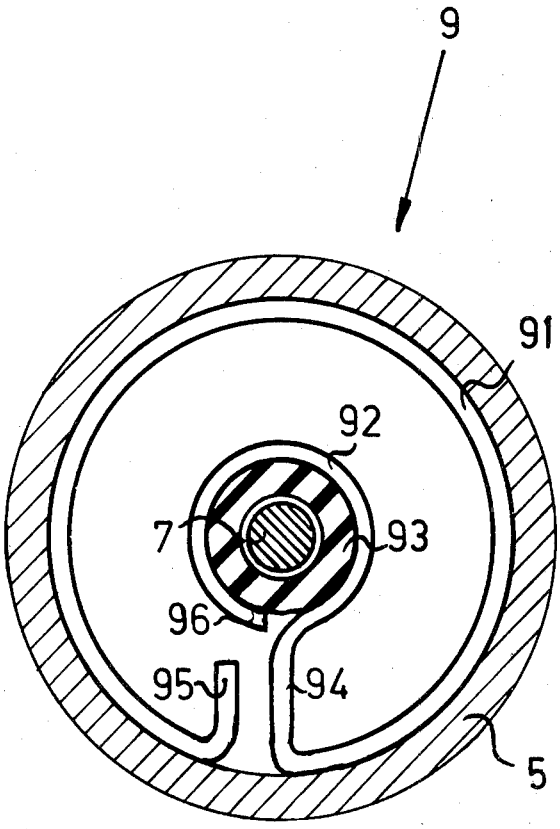

In the drawings there is shown:

FIG. 1, a schematic partially cutaway view showing construction of a pump according to this invention; and FIG. 2, a cross section of one embodiment of a resilient bearing according to this invention.

The vessel pump, line pump or barrel pump is shown purely schematically in FIG. 1. An electric motor, such as single-phase alternating current motor 1 with coupling part 2 has off-on switch 3. The delivery pipe or ascending pipe 5 is connected with driving motor 1, through coupling 2 by means of connecting pipe 4 having retaining ring 41. The sealing of the delivery pipe against the motor takes place by means of a slide ring packing which is resistant to acid and alkali solutions. The packing attached above outlet 6 is also the only packing of the entire pump. Contrary to vessel pumps heretofore known, the pump of this invention has no packings in the immersed part. These advantages are obvious. The ascending pipe or delivery pipe 5 is shown partly cutaway. Toward its upper end there is provided outlet 6 having standard measurements and running perpendicular to the delivery pipe. Driving shaft 7 runs along the center longitudinal axis of ascending pipe 5 to delivery rotor 8. The shaft is held in delivery pipe 5 by means of resilient bearings 9. The delivery pipe is open at bottom 51 and has additional intake holes 52. The conveying spirals 81 can be seen on rotor 8. The rotor is connected to the drive shaft in a torsion-resistant fashion. No sealing problems of any kind occur at the bottom of the shaft.

FIG. 2 shows resilient bearing 9. A metal band of resilient material is bent into outer annular retainer spring 91 and inner annular retainer spring 92. By clamping action, inner annular retainer spring 92 retains sleeve 93 which serves as a slide bearing for driving shaft 7. Dependent on the use, sleeve 93 can be made of polypropylene, bronze, polytetrafluoroethylene, etc. Cross bar 94 runs radially between two concentric springs 91, 92 effecting the resilient bearing of shaft 7. The end of outer annular retainer spring 91 has a side bar 95 parallel to cross bar 94. For installation or removal of bearing 9, side bar 95 and cross bar 94 are squeezed together whereby the diameter of outer annular retainer spring 91 is decreased. When inner end 96 of annular retainer spring 92 is spread apart, for instance by means of a screwdriver, sleeve 93 can be easily replaced.

Resilient bearings 9 can absorb different oscillations of the driving shaft which are dependent directly on the number of revolutions and indirectly on the viscosity of the medium to be conveyed. Consequently, forces transmitted to the coupling are reduced.

The simplified construction results in the new vessel pump or barrel pump of this invention having about 60% less wearing of parts than pumps of this type previously used. The need for repair is consequently less. With the same delivery rotor and the same driving unit, the capacity is increased approximately 15% due to the larger useful cross section of the delivery pipe.

As a result of the present invention great advantages are achieved by simple means. Considerable projudices and problems had to be overcome in connection with the simple solution of this invention. There was the special problem that the shaft had to be placed in a pipe in which media flows which may be very corrosive. An added factor is that the bearing should reduce the useful cross section of the delivery pipe as little as possible. The vessel pump as defined in this invention solves these problems advantageously.

The selection of the material is an important factor. This is true not only, as described above, for sleeve 93 but also for the material from which annular retainer springs 91 and 92 are made. The concentric annular retainer springs and the cross bar between them may be spring steel and stainless steel such as that having the trade name V4A, being especially suited. For special applications the concentric retainer springs may be advantageously coated with synthetic material or provided with an electrochemically applied protective layer, such as nickel.

In addition to the form of bearing 9 shown in FIG. 2, other forms can be used. In FIG. 2, outer annular retainer spring 91 seen from the side bar 95 is bent clockwise and the inner annular retainer spring 92 is bent counter-clockwise. Outer annular retainer spring 91 and inner retainer spring 92 may also be formed from a single piece in the same bending directions. Also, the cross bar does not definitely have to run radially. In case especially great elasticity of the bearing is required, the cross bar can also be spiral-shaped.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

I claim:

1. A vessel pump comprising a driving motor, a driving shaft driven by said motor and extending in a delivery pipe and having a delivery rotor arranged in the lower region of said driving shaft, characterized by the fact that said driving shaft is provided in at least one location with a resilient bearing supported in said delivery pipe, said bearing comprising two concentrically arranged annular retainer springs consisting of a single piece, the inner annular retainer spring holding a replaceable slide bearing sleeve through which said driving shaft extends and the outer annular retainer spring adjacent and supported by said delivery pipe.

2. Vessel pump as defined in claim 1 wherein said resilient bearing has a cross bar connecting said concentric annular retainer springs and runs radially to said driving shaft.

3. Vessel pump as defined in claim 1 wherein said concentric annular retainer springs are formed from a single piece in opposite bending directions.

4. Vessel pump as defined in claim 1 wherein said concentric annular retainer springs are formed from a single piece and have the same bending direction.

5. Vessel pump as defined in claim 1 wherein said outer annular retainer spring is formed at its outer end into a side bar running parallel to a connecting cross bar between said annular springs.

6. Vessel pump as defined in claim 1 wherein said concentric annular retainer springs are made of spring steel.

7. Vessel pump as defined in claim 6 wherein said concentric annular retainer springs are coated with synthetic material.

8. Vessel pump as defined in claim 1 wherein said sleeve held in the inner annular retainer spring is material which is resistant to chemically corrosive agents and has good sliding properties.

9. Vessel pump as defined in claim 8 wherein said sleeve is made of polytetrafluoroethylene.

10. Vessel pump as defined in claim 8 wherein said sleeve is made of bronze.

11. Vessel pump as defined in claim 8 wherein said concentric annular retainer springs are provided with a metallic coating.

* * * * *